US009328906B1

(12) United States Patent
Bennington

(10) Patent No.: US 9,328,906 B1
(45) Date of Patent: May 3, 2016

(54) SOLAR LIGHTING BLINDS SYSTEM

(71) Applicant: Eric N. Bennington, Houston, TX (US)

(72) Inventor: Eric N. Bennington, Houston, TX (US)

( * ) Notice: Subject to any disclaimer, the term of this patent is extended or adjusted under 35 U.S.C. 154(b) by 0 days.

(21) Appl. No.: 14/274,397

(22) Filed: May 9, 2014

Related U.S. Application Data

(60) Provisional application No. 61/822,342, filed on May 11, 2013.

(51) Int. Cl.
*F21S 9/00* (2006.01)
*F21V 23/04* (2006.01)
*F21S 9/03* (2006.01)

(52) U.S. Cl.
CPC *F21V 23/04* (2013.01); *F21S 9/037* (2013.01)

(58) Field of Classification Search
CPC ..... F21S 9/03; F21S 9/037; F21V 23/04
USPC ..... 362/183
See application file for complete search history.

(56) References Cited

U.S. PATENT DOCUMENTS

| | | | | |
|---|---|---|---|---|
| 3,867,621 | A * | 2/1975 | Gewfrtz et al. | 362/394 |
| 6,120,165 | A * | 9/2000 | Shalvi | 362/276 |
| 2009/0206759 | A1 * | 8/2009 | Wang et al. | 315/151 |

* cited by examiner

*Primary Examiner* — Sharon Payne
(74) *Attorney, Agent, or Firm* — Plager Schack LLP

(57) ABSTRACT

A solar lighting blinds system is configured to provide light. The system includes blinds attached to a component housing. An LED bar is attached to the component housing. A switch is attached to the component housing. A solar panel is attached to the component housing. A battery is contained within the component housing. A microprocessor is contained within the component housing. The microprocessor is electrically coupled to the LED bar, the switch, the solar panel and the battery and configured to charge the battery with the solar panel and then direct power from the battery to the LED bar when directed by the switch.

6 Claims, 4 Drawing Sheets

SOLAR LIGHTING BLINDS SYSTEM

RELATED APPLICATION

This application claims priority to provisional patent application U.S. Ser. No. 61/822,342 filed on May 11, 2013, the entire contents of which is herein incorporated by reference.

BACKGROUND

The embodiments herein relate generally to window coverings. In particular the embodiments herein relate to window coverings that generate and utilize electrical power.

Prior to embodiments of the disclosed invention, there was no solar powered lighting system integrated with vertical blinds. Embodiments of the disclosed invention solve this problem.

SUMMARY

A solar lighting blinds system is configured to provide light. The solar lighting blinds system includes blinds attached to a component housing. An LED bar is attached to the component housing. A switch is attached to the component housing. A solar panel is attached to the component housing. A battery is contained within the component housing. A microprocessor is contained within the component housing. The microprocessor is electrically coupled to the LED bar, the switch, the solar panel and the battery and configured to charge the battery with the solar panel and then direct power from the battery to the LED bar when directed by the switch.

In some embodiments, another solar panel can mechanically coupled to the blinds and electrically coupled to the microprocessor. A motion sensor can be mechanically coupled to the component housing and electrically coupled to the microprocessor in order to energize the LED bar when motion is detected. A light sensor can be mechanically coupled to the component housing and electrically coupled to the microprocessor in order to turn off the LED bar when light is detected.

In some embodiments, an LED can be mechanically coupled to the component housing, electrically coupled to the microprocessor and separated from the LED bar. A motion sensor can be mechanically coupled to the component housing and electrically coupled to the microprocessor in order to energize the LED when motion is detected. A light sensor can be mechanically coupled to the component housing and electrically coupled to the microprocessor in order to turn off the LED when light is detected.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
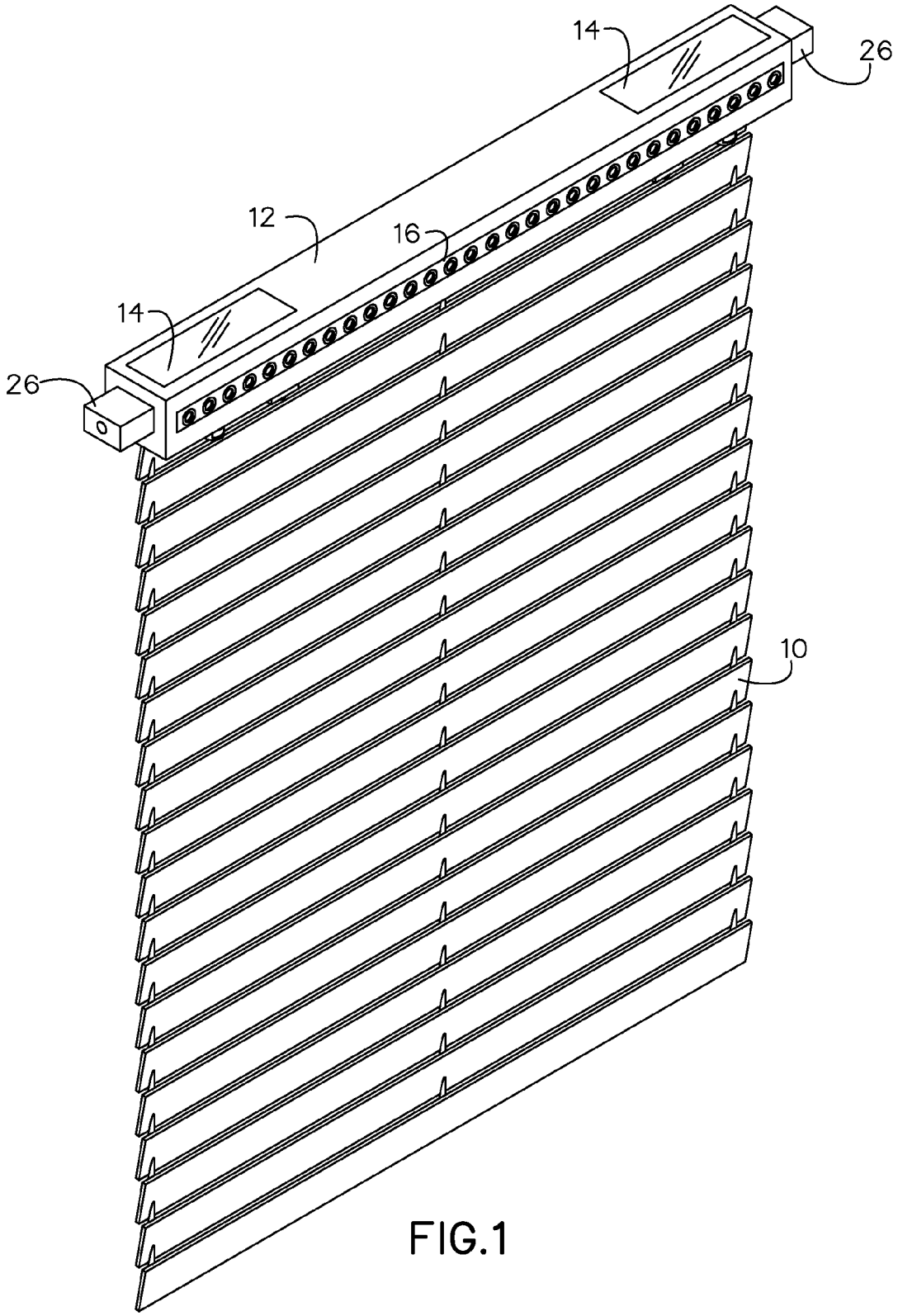
FIG. 1 is an interior perspective view of an embodiment of the invention.
Figure 2:
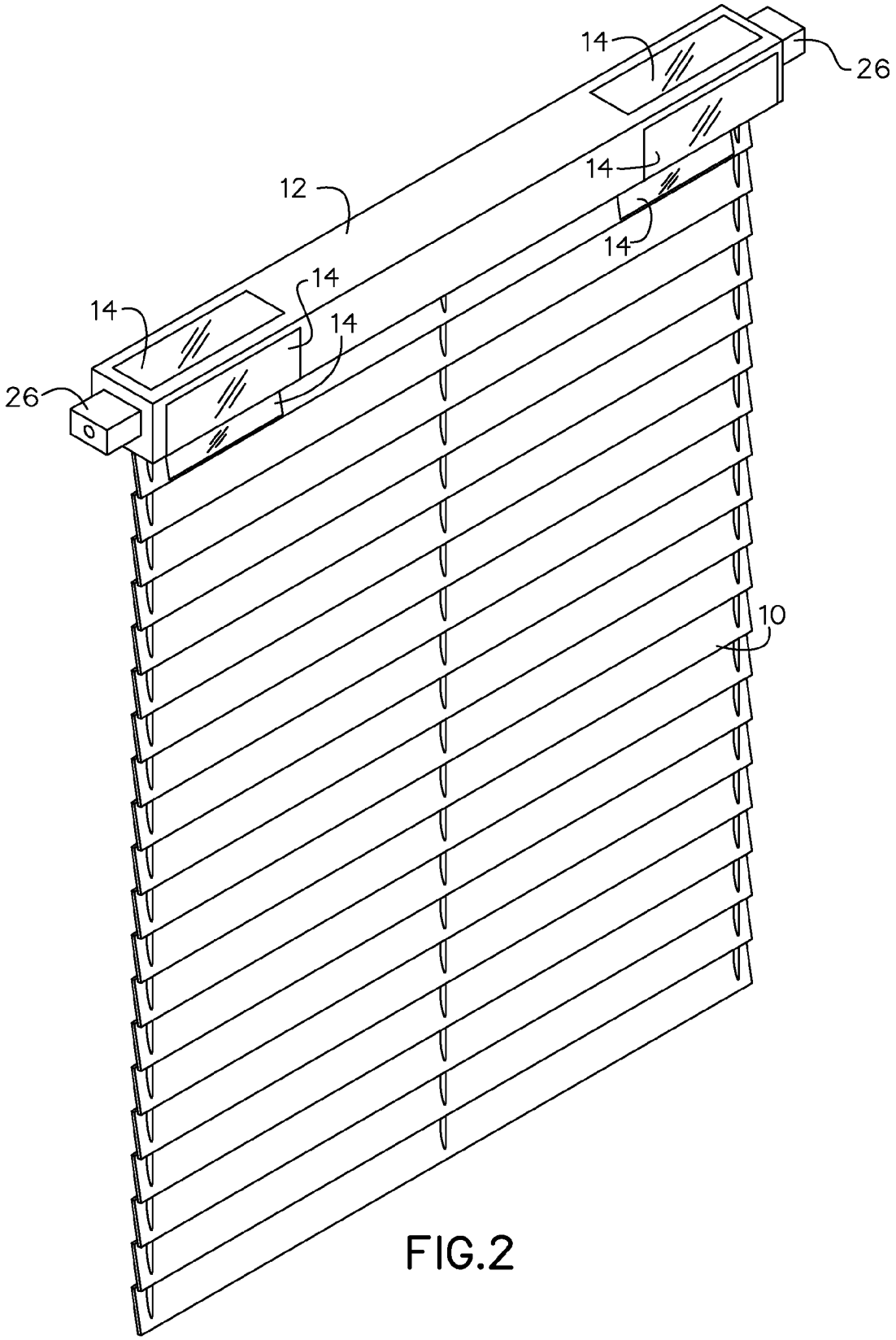
FIG. 2 is an exterior perspective view of an embodiment of the invention.

By way of example, and referring to FIG. 1 and FIG. 2, one embodiment of the solar lighting blinds system comprises blinds 10 attached to component housing 12. Component housing 12 has the shape of a modified parallelepiped with a top side mechanically coupled to two solar panels 14. A back side of component housing 12 is mechanically coupled to two more solar panels 14. A front side of component housing 12 is mechanically coupled to light emitting diode (LED) bar 16. In some embodiments, LED bar 16 is a high intensity multi-color LED light bar. In some embodiments, a back side of blinds 10 can be mechanically coupled to additional solar panels 14.

Figure 3:
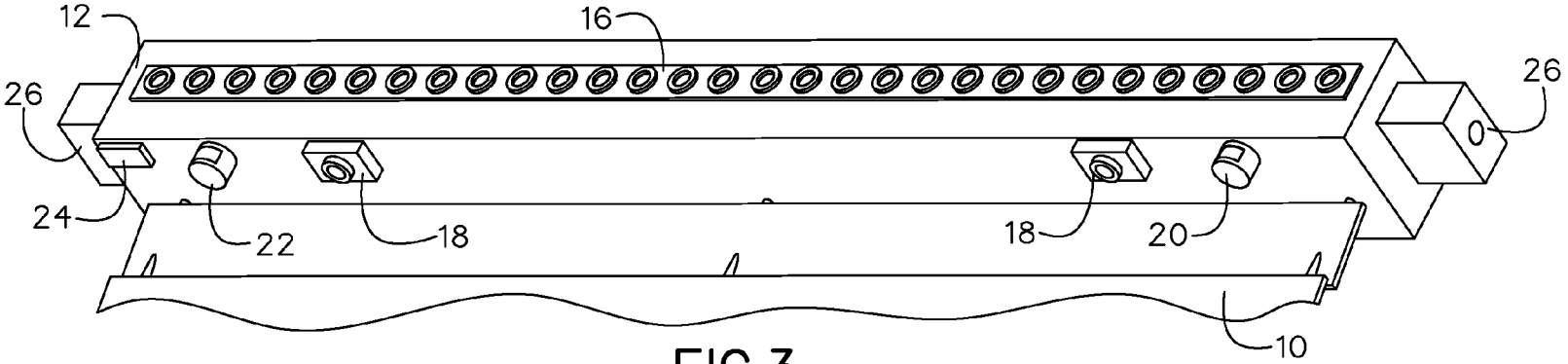
FIG. 3 is a bottom detail perspective view of an embodiment of the invention.
Figure 4:
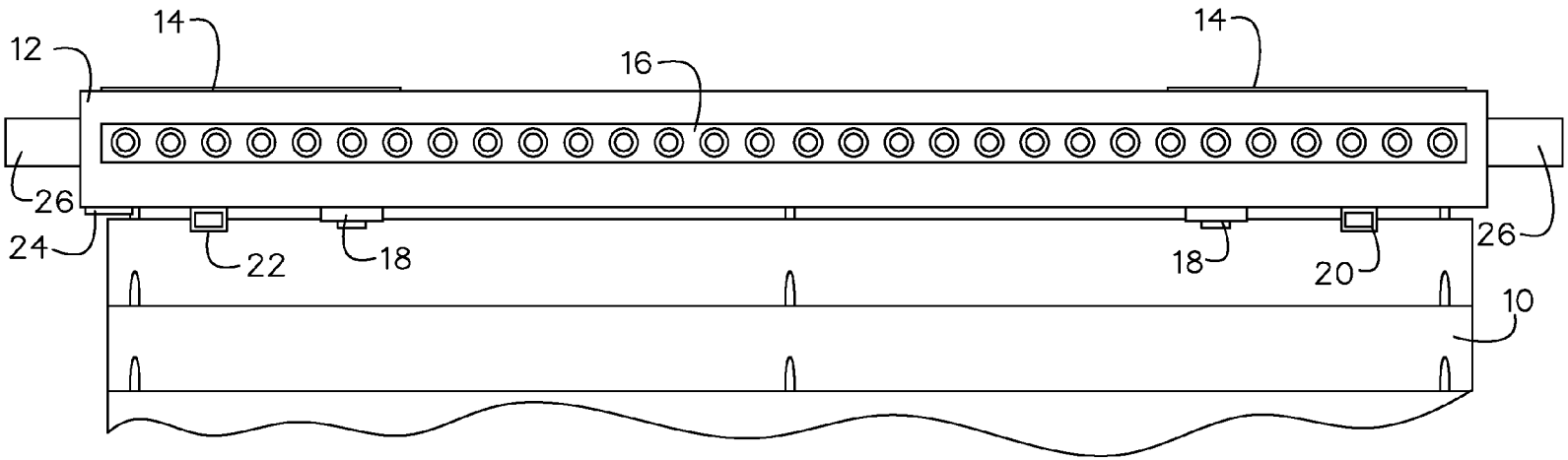
FIG. 4 is an interior perspective detail view of an embodiment of the invention.

Turning to FIG. 3 and FIG. 4, a bottom side of component housing 12 is mechanically coupled to two LEDs 18, motion sensor 20, light sensor 22 and a switch 24. In some embodiments, LED 18 is a high intensity multi-color individual LED. A left side of component housing 12 is mechanically coupled to left tension bracket 26. A right side of component housing 12 is mechanically coupled to right tension bracket 26. Left tension bracket 26 and right tension bracket 26 are configured to expand and contract as necessary such that the system fits in a window frame. In some embodiments, this can be done with a pair of springs, one on each tension bracket 26.

Figure 5:
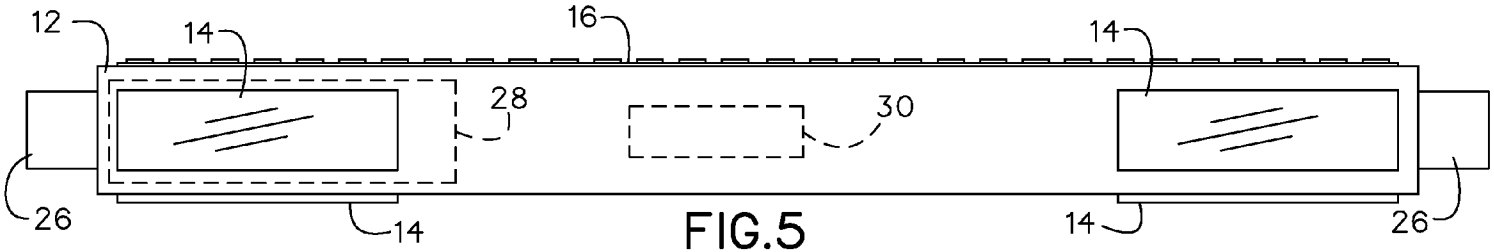
FIG. 5 is top view of an embodiment of the invention.
Figure 6:
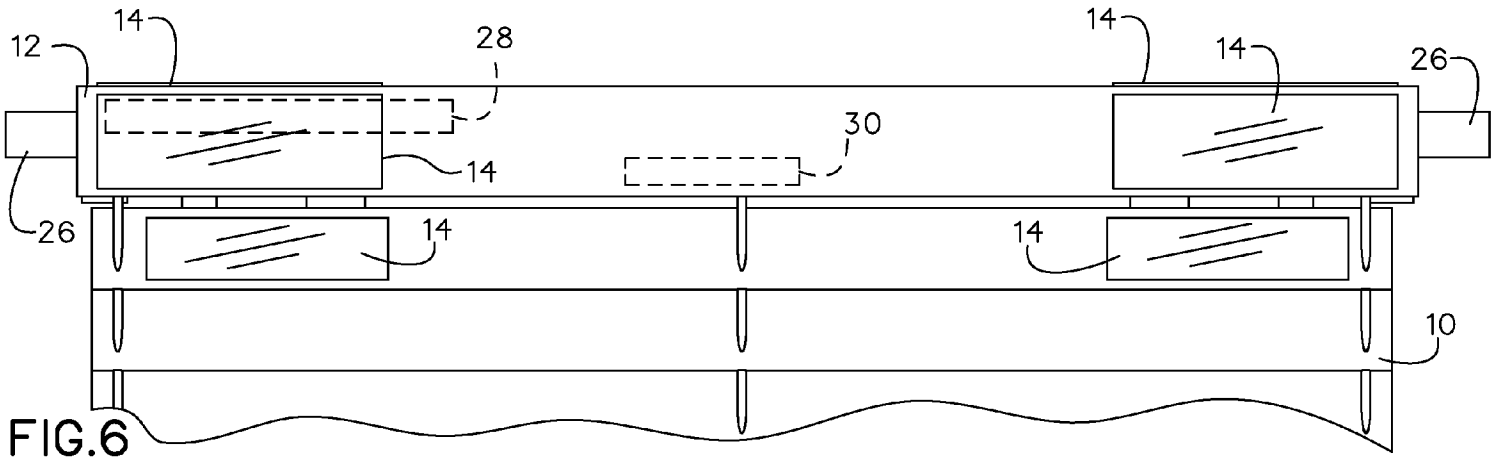
FIG. 6 is an exterior perspective detail view of an embodiment of the invention.

FIG. 5 and FIG. 6 offer one theory of electrical wiring for the system. Microprocessor 30 is electrically coupled to battery 28. Microprocessor 30 is further electrically coupled to each solar panel 14, LED bar 16, each LED 18, motion sensor 20, light sensor 22 and switch 24. Microprocessor 30 is configured to send and receive electrical power from battery 28. When light interacts with solar panel 14, microprocessor 30 is configured to relay electrical power generated by the light to battery 28, thus charging battery 28.

Microprocessor 30 is configured to provide electrical power to LED bar 16 from battery 28. In some embodiments, this operation can be intimated by toggling switch 24. In other embodiments, this can be initiated by activating motion sensor 20. In other embodiments, this can be initiated by activating light sensor 22.

Microprocessor 30 is configured to provide electrical power to at least one LED 18 from battery 28. In some embodiments, this operation can be intimated by toggling switch 24. In other embodiments, this can be initiated by activating motion sensor 20. In other embodiments, this can be initiated by activating light sensor 22.

A user can configure, motion sensor 20, light sensor 22, and switch 24 to engage or disengage and combination of LEDs 18 and LED bar 16 based on user preference. For instance, in a bathroom, using motion sensor 20 to determine the proximity of a user can provide some light, with LEDs 18 to assist a user in finding something in the bathroom when it is dark. In another embodiment, light sensor 22 can turn off LEDs 18 and LED bar 16 when there is ambient light already present in the room. In another embodiment, LEDs 18 can engage when there is no ambient light in the room acting as a night light for children. In other embodiments, LEDs can be arranged to advertise a product, provide security lighting, indicate whether a store is open or artistically decorate an accent wall. In some embodiments, the LEDs can be multi-directional LEDs.

Figure 7:
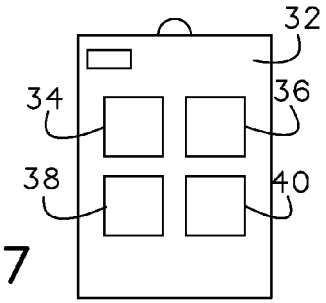
FIG. 7 is a top view of an embodiment of the programmable remote control.

In some embodiments, programmable remote control 32 can be used to configure, motion sensor 20, light sensor 22, and switch 24 to engage or disengage and combination of LEDs 18 and LED bar 16 as shown in FIG. 7. Programmable remote control 32 comprises dimmer button 34, color button 36, timer button 38 and motion button 40.

Programmable remote control 32 is communicatively coupled to microprocessor 30 in a known way. For instance, in some embodiments programmable remote control can communicate with microprocessor 30 with Bluetooth connectivity, WiFi, or radio frequency among others.

Dimmer button 34 can be used to increase or decrease electrical power to either LEDs 18, LED bar 16, or both to make LEDs 18, LED bar 16, or both appear brighter or dimmer. Color button 36 can toggle the color or colors displayed by either LEDs 18, LED bar 16, or both when either LEDs 18, LED bar 16, or both use multi-color LEDs. Timer button 38 can either be coordinated with a clock to determine a time for either LEDs 18, LED bar 16, or both to turn on or off, to change color or to increase or to become brighter or dimmer. Motion button 40 is configured to allow motion sensor 20 discern when to turn on or off, to change color or to increase or to become brighter or dimmer for either LEDs 18, LED bar 16, or both.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A solar lighting blinds system configured to provide light; the solar lighting blinds system comprising:

blinds attached to a component housing; wherein the blinds further comprise a pair of braided ladders;

an LED bar, attached to the component housing;

a switch, attached to the component housing;

a solar panel, attached to the component housing;

a battery, contained within the component housing; and a microprocessor contained within the component housing;

another solar panel mechanically coupled to the blinds and electrically coupled to the microprocessor with electrical wires between the pair of braided ladders;

wherein the microprocessor is electrically coupled to the LED bar, the switch, the solar panel and the battery and configured to charge the battery with the solar panel and then direct power from the battery to the LED bar when directed by the switch.

2. The solar lighting blinds system of claim 1, further comprising a motion sensor mechanically coupled to the component housing and electrically coupled to the microprocessor in order to energize the LED bar when motion is detected.

3. The solar lighting blinds system of claim 1, further comprising a light sensor mechanically coupled to the component housing and electrically coupled to the microprocessor in order to turn off the LED bar when light is detected.

4. The solar lighting blinds system of claim 1, further comprising an LED mechanically coupled to the component housing, electrically coupled to the microprocessor and separated from the LED bar.

5. The solar lighting blinds system of claim 4, further comprising a motion sensor mechanically coupled to the component housing and electrically coupled to the microprocessor in order to energize the LED when motion is detected.

6. The solar lighting blinds system of claim 4, further comprising a light sensor mechanically coupled to the component housing and electrically coupled to the microprocessor in order to turn off the LED when light is detected.

* * * * *